United States Patent [19]

Deschamps

[11] 4,088,925

[45] May 9, 1978

[54] METHOD OF UTILIZING A STORAGE TUBE EMPLOYING A NON-DESTRUCTIVE READING

[75] Inventor: Jacques Deschamps, Paris, France

[73] Assignee: Thomson-CSF, Paris, France

[21] Appl. No.: 736,887

[22] Filed: Oct. 29, 1976

[30] Foreign Application Priority Data

Nov. 4, 1975 France ..... 75 33699

[51] Int. Cl.[2] ..... H01J 29/50; H01J 31/00

[52] U.S. Cl. .....315/13 ST; 315/8.5; 365/811

[58] Field of Search ..... 315/13 ST, 8.5; 313/391; 340/173 CR; 358/140

[56] References Cited

PUBLICATIONS

Courtan et al., *Memory Recording Tubes,* Revue Technique Thomson-CSF, vol. 3, No. 4, Dec. 1971, pp. 695–725.

*Primary Examiner*—Maynard R. Wilbur
*Assistant Examiner*—T. M. Blum
*Attorney, Agent, or Firm*—Roland Plottel

[57] ABSTRACT

The invention relates to storage tubes having a dielectric target in which the writing is effected by a beam of slow electrons supplying the target with negative charges in an amount which is a function of the data to be written. The new method mainly consists in: causing each writing of a zone of the target to be followed by a sweeping of said zone with rapid electrons supplying at each written point a small quantity of positive restoring charges, whereby it is possible to reach an equilibrium potential within a finite and regulatable time while avoiding the phenomenon of integration.

8 Claims, 4 Drawing Figures

METHOD OF UTILIZING A STORAGE TUBE EMPLOYING A NON-DESTRUCTIVE READING

Figure 1:
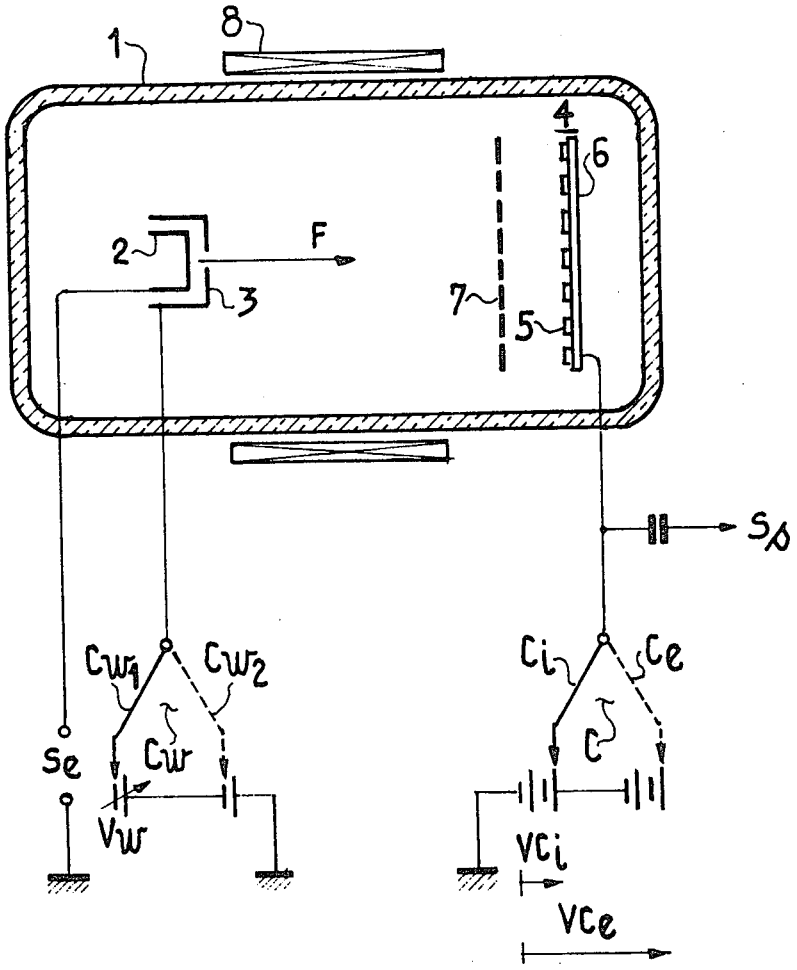

The present invention relates to a new method of utilizing a storage tube employing a non-destructive reading, in which the information or data is stored on a storage target in the form of an electrical image which is of good quality and stable even for long or repeated recording periods; it also concerns display systems in which the storage tubes are employed in accordance with this new method.

The storage tubes concerned in the present invention are tubes in which the data, applied to the tube in the form of an electrical signal, are recorded on a storage target by means of a beam of electrons sweeping the different zones of said target, and in which the reading of this data is not destructive.

By way of an example, the invention is applicable particularly well, as will be understood from the ensuing description, to recording storage tubes (RST) or to image maintaining tubes (IMT).

These two types of tubes indeed have in common the features necessary to the present invention, namely the storage of an electrical image on a target consisting of a mosaic of dielectric islands (or dielectric strips) by means of an inscription of writing in the course of the sweeping of the mosaic by a beam of writing electrons and the non-destructive reading. The description will be more particularly made with the study of a recording storage tube RST; it will be seen here inafter how it can be very simply turned into an image maintaining tube IMT.

A recording storage tube RST can conventionally be employed in two different ways.

In a first mode of utilization, which is the most frequent, the writing beam which strikes the storage target constituted by a dielectric mosaic on a conductive plate, is a beam of rapid electrons capable of producing an emission of secondary electrons having a coefficient $\delta$ greater than 1, that is to say of producing on the dielectric thus struck a decrease in the negative electric charges. The data to be recorded modulates the beam current whose intensity is a function of the level of the signal to be recorded. The quantity of negative charges removed in the different zones of the dielectric is thus a function of the data to be recorded thereon. The reading of the electrical image stored on the target is achieved by a sweeping or scanning of the target by a beam of slow electrons; a video signal is received on the plate supporting the dielectric.

Although this mode of utilizing RSTs is the most usual, it has serious drawbacks, when the recording is not achieved within short times, either because the sweep is itself slow, or because the recording is effected several times with no erasing between the different passages of the writing beam. Indeed, there is produced when the writing is prolonged or is achieved with an excessively intense beam, a saturation of the target which is of course all the more harmful as a correct reproduction of "halftones" is desired.

In order to avoid these drawbacks of RSTs in utilizations in which the recording speed is very slow or may vary within large proportions, or when the writings are effected in several sweeps, it is known to employ the storage tubes in another mode.

This second mode of utilization comprises inscribing or writing the data, not with a beam of rapid electrons modulated in intensity, but with a beam of slow electrons, that is to say by producing an emission of secondary electrons having a coefficient $\delta$ less than 1. In this case and in accordance with a wellknown property of secondary emission phenomenon, there is observed a phenomenon of the putting of the dielectric in equilibrium with respect to the potential of the cathode of the electron gun. In other words, the slow beam deposits electrons on the surface of the dielectric as long as the potential of this surface is more positive than that of the cathode. When the potential of the target reaches that of the cathode, there is a stable equilibrium.

Consequently, to write the data, it is sufficient to modulate at the rhythm of the input signal carrying this data, the difference of potential between the cathode and the target, this modulation being effected indifferently on the target or on the cathode. The potential relief deposited at each point of the target will thus be exactly equal to the value of the targetcathode potential difference at the instant at which the beam writes on this target element. A more detailed operation will be described hereinafter, in particular in its reading and erasing stages. It is sufficient here for a comprehension of the interest of the new method of the invention to know the "writing" mode of operation of the tube.

In is clear that as the writing is carried out by putting the dielectric in equilibrium, there can be no phenomenon of saturation is such a mode of writing, whatever be the writing speed.

On the other hand, it is observed that this writing mode has another defect which is particularly troublesome when it is desired that the stored image be of very high quality and of high stability with respect to time. Indeed, the description of the operation with $\delta < 1$ just given, and which is based on putting the dielectric in equilibrium, is true only as a first approximation; indeed, experiments reveal a very important secondary phenomenon.

Indeed, the equilibrium potential reached by the dielectric receiving the impact of a beam of low-energy electrons is equal to the potential of the cathode, in the hypothesis that all the electrons emitted by the cathode have the same initial energy upon their departure from the cathode. Now it is known that these electrons have not equal energies and that, in fact, there exists a distribution of energy of these electrons which may be considered to be a Boltzman distribution. Consequently, whereas the equilibrium of the dielectric should be reached when the potential of this dielectric is that of the cathode, or, more precisely, when the cathode-target potential difference V is null, this is not so. Electrons whose initial energy is not null because of this energy distribution continue to reach the dielectric and lower its potential which becomes more negative than that of the cathode instead of remaining equal thereto.

This phenomenon is very troublesome, since the potential of equilibrium of the dielectric, is never reached, as will be seen hereinafter. Thus, an adverse phenomenon of integration of the information is produced. The electrical image recorded on the target is therefore a function of the time that the recording took or of the number of successive writing sweeps.

A deterioration of the image results. It is indeed impossible to wait a very long, theoretically infinite, time to attain a stable potential. This deterioration is all the more troublesome as the writing speed is not uniform in the course of a complete sweeping of the target; in this case deteriorations will be obtained which are more or less considerable in the different zones of the target and consequently there is a loss of information, in particular in the half-tones.

Everything that has been mentioned about recording storage tubes RST is transposable to image maintaining tubes. Indeed, it may be considered that, apart from the manner in which the recorded electrical images are read, the image maintaining tubes are comparable to the recording storage tubes. In the IMTs the dielectric is deposited, not on a solid metal plate, but on a metal grid. The electrical image stored on this target is converted not into a video signal but into an optical image. For this purpose, the reading beam which sweeps or scans the target of an RST is replaced by a beam termed "maintaining" beam which permanently bombards the target with slow electrons during the reading periods. These electrons cross the target in more or less large numbers, depending on the data which had been stored thereon, and illuminate the phosphors of a luminescent screen and convert the electrical image into an optical image.

As concerns the writing mode, it is identical to that of the RSTs; it is carried out conventionally with rapid electrons, which is not the object of the invention. It can be carried out, as in the RSTs, with slow electrons and presents the same problem of integration and equilibrium impossible to attain within reasonable times.

The object of the invention is to provide a new method of utilization of storage tubes employing a non-destructive reading, thereby it is possible to produce inscriptions or writing beam of slow electrons while avoiding the adverse effects of the phenomenon of integration inherent in this mode of writing.

According to the invention, there is provided a new method of utilizing a storage tube employing a non-destructive reading adapted to record data applied thereto in the form of an electrical signal and comprising in a vacuum enclosure, at least one electron gun capable of sending a thin beam of electrons toward a storage target comprising dielectric elements on a conductive electrode, and means for deflecting said beam capable of causing it to sweep said target, comprising for storing an electrical image corresponding to said data on the dielectric the following steps:

1. applying the electrical signal containing the data to be written across the cathode of said electron gun and said target so as to modulate the target-cathode potential difference;
2. controlling the means for deflecting said beam in such manner as to deflect it over the target in accordance with a predetermined sweeping mode;
3. polarizing said target at a continuous potential which is slightly positive with respect to the potential of said cathode so that said beam is a beam of slow electrons and writes said data by a deposit of negative charges on the zones swept in accordance with 2.;
4. each time that a predetermined zone of the target, which may range from a line to the whole target, has thus been written, switching the potential of the target to a continuous value which is sufficiently positive with respect to the cathode so that said beam is a beam of rapid electrons capable of removing negative charges from the dielectric that it will strike and, simultaneously, controlling said beam deflecting means in such manner as to cause the beam to sweep said predetermined zone on the target, the quantity Q of negative charges thus removed from the dielectric after each writing being regulated by the choice of the beam current of said beam of rapid electrons in such manner as to put the potential of the dielectric in equilibrium within a predetermined time.

This method, whereby it is possible to attain an equilibrium potential of the dielectric within a finite and regulatable time, is in particular applicable to single-gun or double-gun recording storage tubes RST and to image maintaining tubes.

It may be employed practically irrespective of the sweeping mode utilized and in particular a television-type sweeping with lines and frames, a radar-type sweeping, etc.

The invention also relates to display systems employing storage tubes in which this method is utilized.

Figure 2:
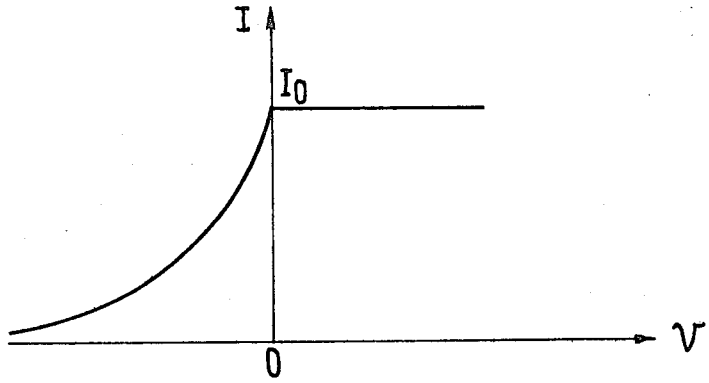
Figure 3:
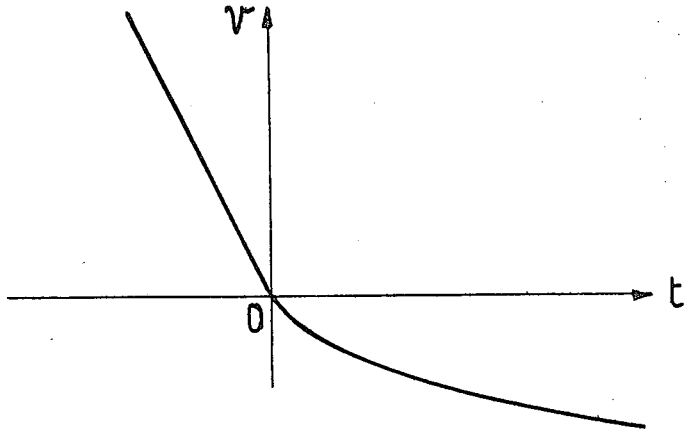
Figure 4:
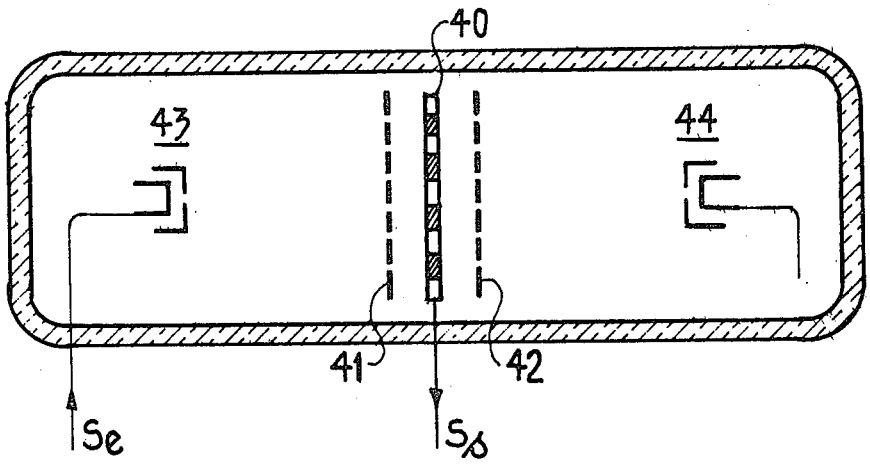

Other objects, features and results of the invention will be apparent from the ensuing description which is given by way of a non-limitative example and illustrated by the accompanying figures which represent:

FIG. 1, a very diagrammatic sectional view of the elements of a single-gun recording storage tube necessary for the explanation of the method of the invention;

FIGS. 2 and 3, curves giving the appearance of the charging current and of the potential of the dielectric of a storage target as a function respectively of this same potential of the dielectric, and of time, when the method of the invention is not employed;

FIG. 4, a very diagrammatic sectional view, of the essential elements of a bigun recording storage tube to which the method of the invention is applicable.

The recording storage tubes per se will not be described here in detail. They are indeed well known and are described in many works, such as the THOMSON-CSF technical review, Volume 3, No. 4 of December, 1971, pages 695 to 725.

Only the elements necessary to the comprehension of the invention will be described and illustrated here.

There are shown in FIG. 1 in a vacuum enclosure 1 the essential parts of a single-gun RST, namely its electron gun represented by its cathode 2 and its electrode controlling the beam current or Wehnelt electrode 33, and its storage target 4. This target is conventionally composed of dielectric elements 5 deposited on a conductive electrode 6. They will be, for example, stude or strips of insulating silica produced on a substrate of conductive silicon. There has also been shown the electrode collecting the electrons which have not been captured by the target or emitted by the latter, often termed a field grid 7, and there has been symbolically represented at 8 the means for deflecting the beam of electrons F emitted by the gun.

As has already been briefly explained, the method of utilization of such a tube according to the invention concerns a mode of writing with slow electrons.

To simplify the description, there will be taken the example of a tube which is swept for the writing and the reading in accordance with a television-type of sweeping. However, it must be understood that the method of the invention also concerns other types of sweeping and it is unnecessary that the writing and reading sweepings be of the same type.

The input signal $S_e$ containing the data or information to be recorded is applied, as has already been mentioned, across the cathode and the target; it here modulates the cathode potential.

The writing is carried out by switching the target 6 to a continuous potential which is slightly positive with respect to the continuous potential of the cathode, which is here the earth; let $VC_i$ be this writing potential. While the signal $S_e$ modulates the target-cathode potential difference, the beam F is deflected in synchronism with the input video signal, along a line of the target, and deposits electrons on the dielectric, the secondary emission coefficient $\delta$ being less than 1 for the chosen $VC_i$ potential.

The aforementioned phenomenon of integration now appears if the method of the invention is not employed, as may be explained with the aid of FIGS. 2 and 3.

The curve of FIG. 2 represents the current I which charges the dielectric when a writing is produced by the supply of negative charges as a function of the potential v on the free surface of the dielectric.

As long as the potential v of the dielectric is positive with respect to the potential of the cathode, bearing in mind of course the input signal $S_e$, the charging current is constant; it is the total beam current $I_o$.

When the potential v is cancelled out and becomes negative, this current is not cancelled out owing to the energy distribution of the electrons of the beam, which may be assumed to be a Boltzman distribution. The current effectively captured by the dielectric is of the form $$I = I_o e^{v/v_o}$$

wherein $e.v_o$ represents the most probable energy for an electron. There is observed a decrease in the charging current, as indicated on the the left side of FIG. 2.

The curve of FIG. 3 represents the evolution of the potential v on the free surface of the dielectric in the course of time.

As long as this potential $v$ is positive, the charging current I is constant and $v$ decreases linearly with time until it becomes null. If C represents the capacitance of the considered target element, there is obtained:

$$v = -\frac{I_o}{C} t + Cte$$

On the other hand, when $v$ is cancelled out and becomes negative, the charging current is no longer constant and there is obtained:

$$\frac{dv}{dt} = -\frac{1}{C} I_o e^{\frac{v}{v_o}}$$

The integration of this differential equation gives, in taking for the initial condition $v = o$ to $t = o$:

$$v = -v_o \cdot \mathrm{Log}\left[1 + \frac{I}{Cv_o} t\right] \quad (1)$$

This equation indicates that the potential v of the insulator will increase in negative values in a logarithmetic manner with time and that the equilibrium potential is never reached, which prohibits the use of this writing mode in applications in which the sweeping speeds when recording may vary within a wide range.

The method of the invention permits remedying this drawback inasmuch as the equilibrium is reached within a finite time $\theta$ which may be chosen.

This method comprises causing each writing sweep which supplied at a given point of the dielectric a quantity of negative charges $-Q_i$ which is a function of the information or data to be written, to be followed by a sweep with rapid electrons removing from this same point of the dielectric a quantity of negative charges $-Q$, that is to say supplying it with a quantity of positive charges $+Q$ so that $|Q\uparrow| < |Q_i\uparrow|$. This supply of positive charges $+Q$ will be made after each writing sweep at each written point, and the quantity of charges $+Q$ supplied will be constant for all the written points. An equilibrium will thus be reached at the end of a time $\theta$ which is a function of the choice of Q.

Indeed, the charging current I of the dielectric is, when v is negative, of the form $I = I_o e^{v/v_o}$, and, if the equation (1) is taken into account, $$I = I_o \frac{1}{1 + \frac{I_o}{Cv_o} t} \quad (2)$$

Equation (2) indicates that the charging current decreases in a hyperbolic manner with respect to time.

At time $\theta_1$ after the voltage v of the dielectric has been cancelled out in the course of a writing, the quantity of negative charges deposited per unit time is equal to:

$$-q = -I_o \frac{1}{1 + \frac{I_o}{Cv_o} \theta_1}$$

In then supplying, by means of the method of the invention which consists essentially of sweeping the zones thus written with rapid electrons, a quantity of positive charges $+ q$ per unit of time, the balance of the charges supplied per unit of time is:

$$-q + q = 0$$

The target therefore no longer receives charges and the potential of its dielectric is fixed. A state of equilibrium has been reached. The writing can therefore be as slow and as repetitive as is desired and there will be no phenomenon of integration.

It is clear that the equilibrium potential thus reached will depend on the choice of the quantity of charges + q deposited per unit of time; the positive charges thus deposited will be termed "restored charge". This choice will be made as a function of the time $\theta$ available for reaching the equilibrium.

The explanation of the method of the invention just given did not take into account the type of sweeping employed for supplying the negative charges of the writing stage proper, charge $-Q_i$, then the restored charges. In a general way, it might be considered that the slope of the straight line represented on the left part of FIG. 2 is sufficiently steep so that, practically irrespective of the sweeping speed, when writing, a single passage of the writing beam lowers the potential v of the insulator below zero. It is here that the method of the invention intervenes in a part of the curve (right part) where the potential varies much more slowly.

If there is then supplied permanently a quantity of charges $+ q$ per unit of time, and if it is assumed that the writing is continued at the same time, there is an instant $\theta_1$ defined hereinbefore at which the supply of negative charges due to the writing (right part of FIG. 3) is equal to the supply $+ q$ of restored charges. There is then equilibrium if the two supplies are continued simultaneously.

In actual fact, the phenomena are not continuous; they depend on the sweep sequences. If the sweeps (writing and restoring) are slow and non-repetitive, the charge supplies will be effected wholly in the course of each sequence: writing then restoring. In this case, the time $\theta$ (starting with $v = 0$) to reach equilibrium will be equal to the time $\theta_1$. If the sweeps are rapid and repetitive, the charge supplies will be effected in several times.

To summarize, and once again referring to FIG. 1, the method of the invention consists in the following two stages:

First, writing a predetermined zone of the target by applying the voltage $S_e$ to the cathode for example and by switching the switch C to the writing position $C_i$, while controlling the means for deflecting the writing beam F; there is then a deposit on the different dielectric elements of said zone of a quantity of negative charges $Q_i$ which is a function of the information or data to be written, and of the time $t_i$ during which each of said elements has effectively received the writing beam.

Second, switching the target potential to the value $VC_e$ for obtaining rapid electrons, position $C_e$ of the switch, and once again sweeping said predetermined zone of the target with this rapid electron beam so as to supply at each dielectric point of said zone a quantity of positive restored charges $+ Q = q \times t_2$, wherein $q$ is the quantity of positive charges supplied per unit of time and $t_2$ the time during which each dielectric element receives the restoring beam.

As already mentioned, the time taken by the target to reach its equlibrium potential depends on the quantity of restored charges $+ q$ which it receives per unit of time and surface. The regulation of this quantity is achieved by regulating the intensity of the beam current through the agency of the potential of the Wehnelt electrode $V_w$, the switch $C_w$ being in position $C_{wl}$ which corresponds to a potential which is regulatable and sufficiently negative to ensure that the restored charges are not too strong; they would be liable in this case to produce an erasure of the image.

An important practical application is, as already mentioned, that of a repetitive sweeping and for example of a television type of sweeping. In this case, upon each sweep, the charge and therefore the potential v of the dielectric increases in negative values and prohibits the equilibrium if the method of the invention is not employed.

A convenient way of effecting the "restoration" consists in writing with slow electrons during the forward travels of the beam along a line and in switching the switch C to the position $C_e$ during the return sweep travels so that the beam is then in the conditions $\delta > 1$ and proceeds to the deposit of restored charges.

For each forward sweep, there is deposited a quantity of negative charges $- Q_i$ and for each return travel a quantity of positive charges $+ Q$, with $Q < Q_i$ in absolute value. The negative charge $- Q_i$, which is a function of the data to be written, decreases in absolute value upon each sweep; the equilibrium is reached after the sweep for which $Q_i = Q$ in absolute value. Each forward sweep then supplied a quentity of negative charges $- Q$, which is immediately compensated for by the return sweep which supplies the restored charges $+ Q$.

It is also possible to achieve the restoration, not during the line returns, but during the frame returns, which must then be long enough to allow the beam to sweep all the lines; it is also possible to achieve it by switching one frame in two when writing and the other frame when restoring.

If the sweep is not of the television type, it is sufficient that the restoring beam sweep on the target the zone that the writing beam had swept, whether this is the return of the beam which serves to restore or the beam sweeps the same trace twice: once when writing, once when restoring.

The writing having been achieved as just described, the reading and the erasure of the electrical images stored is effected in a completely conventional manner; the reading is effected by sweeping or scanning the target with a reading beam of slow electrons, more or less refused by the dielectric elements, depending on the electrical charge recorded thereon. The refused electrons are captured by the field grid 7; the electrons captured by the electrode 6 establish a current which constitutes the output video signal $S_s$.

As concerns the erasure, it is achieved by bringing the target to the previously defined potential $VC_e$ and by sweeping it with rapid electrons. The Wehnelt potential $V_w$ is then switched to a value (position $C_{w2}$ of the switch $C_w$) which is less negative than those which permit effecting the restoration. Indeed, it concerns supplying at least as many positive charges as the writing had supplied negative charges. All of the dielectric elements assume as equilibrium potential, the potential $VC_e$ of the target because of the coplanar effect of these targets (see the aforementioned article for an understanding of these phenomena which do not directly concern the invention).

The invention has been described mainly within the framework of single-gun recording storage tubes RSTs. It is just as applicable to double-gun tubes, such as that very diagrammatically shown in FIG. 4 and described in the aforementioned article. In such a tube, the storage target is a thin target 40 having a conductor-dielectric periodic structure on which the charges may be deposited indifferently on one side or the other; a field grid 41 and 42 is disposed on each side of this target. One of the two electron guns, for example 43, is a writing gun whereas the other, 44, is the reading run. Although in this case it is preferable to employ the writing gun as just described for restoring, it is also possible to employ the reading gun for this purpose, since the charges may be indifferently deposited by either of the two guns.

As already mentioned, the invention may be transposed without problem to image-maintaining tubes. A description of these tubes, completely conventional in themselves, is unnecessary here. It is sufficient to apply the invention thereto to effect their writing with a beam of slow electrons. Each writing stage proper will be followed by a restoring stage as described for the RSTs.

What is claimed is:

1. A new method of utilizing a storage tube employing a non-destructive reading adapted to record data which are applied thereto in the form of an electrical signal, and comprising, in a vacuum enclosure, at least one electron gun capable of sending a thin beam of electrons to a storage target comprising dielectric elements on a conductive electrode, and means for deflecting said beam capable of causing it to sweep said target, comprising, for storing an electrical image corresponding to said data on the dielectric, the following steps:

1. applying the electrical signal containing the data to be written across the cathode of said electron gun and said target so as to modulate the target-cathode potential difference;

2. controlling the means for deflecting said beam in such manner as to deflect it over the target in accordance with a predetermined sweeping mode;
3. polarizing said target at a continuous potential which is slightly positive with respect to the potential of said cathode so that said beam is a beam of slow electrons and writes said data by a deposit of negative charges $-Q_i$ on the zones swept in accordance with 2.;
4. each time that a predetermined zone of the target, which may range from a line to the whole target, has thus been written, switching the potential of the target to a continuous value which is sufficiently positive with respect to the cathode so that said beam is a beam of rapid electrons capable of removing negative charges from the dielectric that it will strike, and, simultaneously, controlling said means for deflecting the beam in such manner as to cause it to sweep over said predetermined zone on the target, the quantity $-Q$ of negative charges thus removed from the dielectric after each writing being regulated by the choice of the beam current of said beam of rapid electrons so as to put the potential of the dielectric in equilibrium within a predetermined time.

2. A method of utilizing a storage tube according to claim 1, wherein said predetermined zone of the target is a line, and the supply of negative charges $-Q_i$ by the slow electron beam is effected during the forward travels of the beam along said line, whereas the removal of the negative charges $-Q$ by the rapid electron beam is effected during the return travels of the beam.

3. A method of utilizing a storage tube according to claim 2, wherein the sweep is of the television type.

4. A method of utilizing a storage tube according to claim 1, wherein the sweeping is of the television type and the supply of negative charges $-Q_1$ is effected during the forward travels of the line sweeping, whereas the removal of the negative charges $-Q$ is effected during the return travels of the frame sweeping, the time of said return travels being sufficient to enable the beam to sweep all the lines.

5. A method of utilizing a storage tube according to claim 1, wherein the sweeping is of the television type and the supply of negative charges $-Q_i$ is effected during a frame sweeping, whereas the removal of the negative charges $-Q$ is effected during the following frame sweeping.

6. A method of utilizing a storage tube according to claim 1, wherein said tube is a single-gun recording storage tube.

7. A method of utilizing a storage tube according to claim 1, wherein said tube is a double-gun recording storage tube.

8. A method of utilizing a storage tube according to claim 1, wherein said tube is an image maintaining tube.

* * * * *